US009284795B2

(12) United States Patent
Rogers et al.

(10) Patent No.: US 9,284,795 B2
(45) Date of Patent: Mar. 15, 2016

(54) RISER DISPLACEMENT AND CLEANING SYSTEMS AND METHODS OF USE

(75) Inventors: Henry Eugene Rogers, Duncan, OK (US); David D. Szarka, Duncan, OK (US); Nicolas Rogozinski, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/407,104

(22) PCT Filed: Aug. 28, 2012

(86) PCT No.: PCT/US2012/052672

§ 371 (c)(1),
(2), (4) Date: Dec. 11, 2014

(87) PCT Pub. No.: WO2014/035375

PCT Pub. Date: Mar. 6, 2014

(65) Prior Publication Data

US 2015/0114656 A1 Apr. 30, 2015

(51) Int. Cl.

| | |
|---|---|
| ***E21B 7/12*** | (2006.01) |
| ***E21B 19/00*** | (2006.01) |
| ***E21B 41/00*** | (2006.01) |

(Continued)

(52) U.S. Cl.

CPC ..... *E21B 19/002* (2013.01); *E21B 17/01* (2013.01); *E21B 19/16* (2013.01); *E21B 21/001* (2013.01); *E21B 33/035* (2013.01); *E21B 41/0007* (2013.01)

(58) Field of Classification Search

CPC ..... E21B 17/01; E21B 17/006; E21B 37/00

USPC ..... 166/339, 367, 311

See application file for complete search history.

(56) References Cited

U.S. PATENT DOCUMENTS 4,046,191 A * 9/1977 Neath ..... 166/352
4,307,783 A * 12/1981 Lanmon, II ..... 166/379

(Continued)

FOREIGN PATENT DOCUMENTS

| | | | |
|---|---|---|---|
| EP | 0184973 | A2 | 6/1986 |
| EP | 1676975 | A2 | 7/2006 |
| WO | 2014035375 | A1 | 3/2014 |

OTHER PUBLICATIONS

International Search Report and Written Opinion for PCT/US2012/052672 dated Mar. 27, 2013.

(Continued)

*Primary Examiner* — Matthew R Buck
*Assistant Examiner* — Aaron Lembo
(74) *Attorney, Agent, or Firm* — McDermott Will & Emery LLP; Scott Richardson

(57) ABSTRACT

Disclosed are systems and methods of effectively wiping and displacing a deep water riser prior to disconnection from a blowout preventer. An exemplary riser displacement system includes a mandrel coupled to a work string, a seal containment canister arranged about at least a portion of the mandrel, and a seal assembly movable between an un-deployed configuration, where the seal assembly is arranged within the seal containment canister, and a deployed configuration, where the seal assembly is arranged outside of the seal containment canister, the seal assembly including a sleeve movably arranged about the mandrel and one or more sealing elements disposed at a distal end of the sleeve.

21 Claims, 2 Drawing Sheets

(51) Int. Cl.

| | |
|---|---|
| ***E21B 21/00*** | (2006.01) |
| ***E21B 17/01*** | (2006.01) |
| ***E21B 19/16*** | (2006.01) |
| ***E21B 33/035*** | (2006.01) |

(56) References Cited

U.S. PATENT DOCUMENTS

| | | | | |
|---|---|---|---|---|
| 4,443,132 | A * | 4/1984 | Kotulla et al. | 405/259.5 |
| 5,117,915 | A * | 6/1992 | Mueller et al. | 166/381 |
| 5,181,571 | A * | 1/1993 | Mueller et al. | 166/381 |
| 5,184,686 | A * | 2/1993 | Gonzalez | 175/5 |
| 6,102,120 | A * | 8/2000 | Chen et al. | 166/287 |
| 6,109,353 | A | 8/2000 | Edwards et al. | |
| 6,554,068 | B1 * | 4/2003 | Chatterji et al. | 166/285 |
| 6,896,063 | B2 * | 5/2005 | Chang et al. | 166/386 |
| 7,270,185 | B2 * | 9/2007 | Fontana et al. | 166/358 |
| 7,389,818 | B2 * | 6/2008 | Hoiland | 166/367 |
| 7,624,806 | B2 * | 12/2009 | Booth | 166/311 |
| 8,235,123 | B2 * | 8/2012 | Stokka et al. | 166/357 |
| 8,316,931 | B2 * | 11/2012 | Rondeau et al. | 166/119 |
| 8,327,930 | B2 * | 12/2012 | Rondeau | 166/153 |
| 8,327,937 | B2 * | 12/2012 | Giem et al. | 166/291 |
| 8,387,705 | B2 * | 3/2013 | Heironimus | 166/358 |
| 8,622,131 | B2 * | 1/2014 | Giem et al. | 166/291 |
| 8,789,582 | B2 * | 7/2014 | Rondeau et al. | 166/153 |
| 2003/0000704 | A1 * | 1/2003 | Reynolds | 166/312 |
| 2008/0245528 | A1 | 10/2008 | Stokka et al. | |
| 2010/0018715 | A1 | 1/2010 | Orbell et al. | |
| 2011/0067865 | A1 | 3/2011 | Rondeau | |
| 2014/0090855 | A1 * | 4/2014 | Robichaux et al. | 166/358 |

OTHER PUBLICATIONS

Official Action for Australian Patent Application No. 2012388777 dated Sep. 24, 2015.

* cited by examiner

RISER DISPLACEMENT AND CLEANING SYSTEMS AND METHODS OF USE

This application is a National Stage entry of and claims priority to International Application No. PCT/US2012/052672, filed on Aug. 28, 2012.

BACKGROUND

The present invention relates to offshore drilling applications and, more particularly, to systems and methods of effectively wiping and displacing a deep water riser prior to disconnection from a blowout preventer.

In offshore drilling applications, risers are used as a temporary fluid conduit that communicably couples a subsea wellhead installation, including a blowout preventer, to a drilling facility on the surface, such as a platform or other type of submersible or semi-submersible drilling rig. In operation, risers generally provide a means of circulating drilling fluid, and any additional solids and/or fluids, between the wellbore being drilled and the surface.

During the course of drilling an offshore well, it may be required to disconnect the riser from the wellhead on multiple occasions. For example, during tropical depressions or hurricanes, or other extreme weather conditions, the waves in the ocean can heave up to and exceed fifty feet in depth/height. In such conditions, it is often advisable to disconnect the riser from the wellhead in order to avoid damage to the wellhead and/or the riser string. Disconnecting the riser from the wellhead requires the proper displacement (i.e., removal) and containment of the drilling fluid present within the riser which, if inadvertently discharged directly into the surrounding oceanic environment, could present serious environmental concerns, not to mention fines potentially levied on the operator.

One way of safely removing the drilling fluid from the riser for proper containment is to drop what is known as a wiper plug into the riser until it reaches the wellhead. Upon reaching the top of the wellhead, the wiper plug is then activated, which, in some cases, forces multiple annular sealing elements against the inner wall of the riser and thereby serves as a separation point between the fluids above and below the wiper plug within the riser. The wiper plug is then pumped back to the surface using a spacer fluid injected into the riser at a location below the wiper plug, thereby forcing the wiper plug to ascend the riser string and simultaneously displacing the drilling fluid out of the riser. In most applications, the spacer fluid is seawater, and pumping the wiper plug to the surface fills the riser below the wiper plug with seawater. Upon disconnecting the riser, the seawater spacer fluid can be discharged directly into the ocean with little or no environmental impact.

At least one problem with conventional wiper plugs, however, is that they are typically pumped out of the riser and subsequently deposited into a moon pool or wet porch of the drilling facility at the surface. The wiper plugs must then be retrieved from the moon pool, which is often a very dangerous and difficult task, as can be appreciated by those skilled in the art. Moreover, conventional wiper plugs are not able to be quickly removed from the riser in the event of an ensuing emergency which may require immediate detachment of the riser from the wellhead installation. Instead, conventional wiper plugs are, for the most part, dependent on fluid pressure from the surface, which could take a great deal of time to advance the wiper plug through the entire length of the riser string.

SUMMARY OF THE INVENTION

The present invention relates to offshore drilling applications and, more particularly, to systems and methods of effectively wiping and displacing a deep water riser prior to disconnection from a blowout preventer.

In some aspects of the disclosure, a riser displacement system is disclosed. The system may include a mandrel coupled to a work string, a seal containment canister arranged about at least a portion of the mandrel, and a seal assembly movable between an un-deployed configuration, where the seal assembly is arranged within the seal containment canister, and a deployed configuration, where the seal assembly is arranged outside of the seal containment canister, the seal assembly including a sleeve movably arranged about the mandrel and one or more sealing elements disposed at a distal end of the sleeve.

In other aspects of the disclosure, a method of displacing a volume of a riser is disclosed. The method may include coupling a riser displacement system to a work string, the riser displacement system including a mandrel and a seal containment canister arranged about at least a portion of the mandrel, the seal containment canister having a seal assembly arranged therein that includes a sleeve movably arranged about the mandrel and one or more sealing elements, introducing the riser displacement system into the riser from a surface, the riser being at least partially filled with a drilling fluid, pressurizing the work string and thereby deploying the seal assembly from the seal containment canister, whereby the one or more sealing elements sealingly engage an inner radial surface of the riser, advancing the riser displacement system back towards the surface, and displacing the drilling fluid above the one or more sealing elements from the riser as the riser displacement system is advanced back towards the surface.

In yet other aspects of the disclosure, a method of displacing drilling fluid from a riser extending from a rig floor of an offshore facility is disclosed. The method may include introducing a riser displacement system into the riser at the rig floor, the riser displacement system including a mandrel and a seal containment canister arranged about at least a portion of the mandrel, the seal containment canister having a seal assembly arranged therein that includes a sleeve and one or more sealing elements movably arranged about the mandrel, advancing the riser displacement system to a wellhead installation, deploying the seal assembly from the seal containment canister, sealing an inner radial surface of the riser with the one or more sealing elements thereby separating the drilling fluid present within the riser above the one or more sealing elements from fluids present within the riser below the one or more sealing elements, advancing the riser displacement system back towards the rig floor, and displacing the drilling fluid from the riser as the riser displacement system is advanced back towards the rig floor.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to offshore drilling applications and, more particularly, to systems and methods of effectively wiping and displacing a deep water riser prior to disconnection from a blowout preventer.

The systems and methods described herein provide features and benefits related to riser displacement operations that are not currently available in the oil and gas industry. For example, the disclosed systems achieve efficient and complete displacement of a deep water riser by running a seal assembly into the riser and retrieving the same while maintaining constant connection to a work string. As a result, the seal assembly may be removed from the work string at the rig floor, instead of from a moon pool or a wet porch, which would otherwise prove a difficult and time-consuming task to undertake. Also, the seal assembly is able to be run into the riser without contacting the inner diameter of the riser, thereby minimizing surge and/or swab effects that may occur on the riser. The exemplary seal assembly may further be designed to account for rig heave which is common in many offshore environments when the riser must be disconnected from a blowout preventer in a short timeframe. Moreover, if operational conditions warrant, the seal assembly is designed such that it may be pulled from the riser quickly.

Other advantages and benefits that may be provided by the disclosed systems and methods include a reduction on the environmental impact of displacing the riser. For instance, the disclosed systems and methods reduce or otherwise entirely eliminate drilling fluid discharges into the surrounding oceanic environment. Moreover, the sealing assembly effectively separates the spacer fluid being injected into the riser from drilling fluids being displaced therefrom, thereby minimizing drilling fluid contamination which equates to reduced drilling fluid disposal costs. Furthermore, the efficiency of the disclosed systems and methods reduce riser displacement time, thereby minimizing work boat standby charges. Through the discussion below, additional advantages and benefits will become apparent to those skilled in the art.

Figure 1:
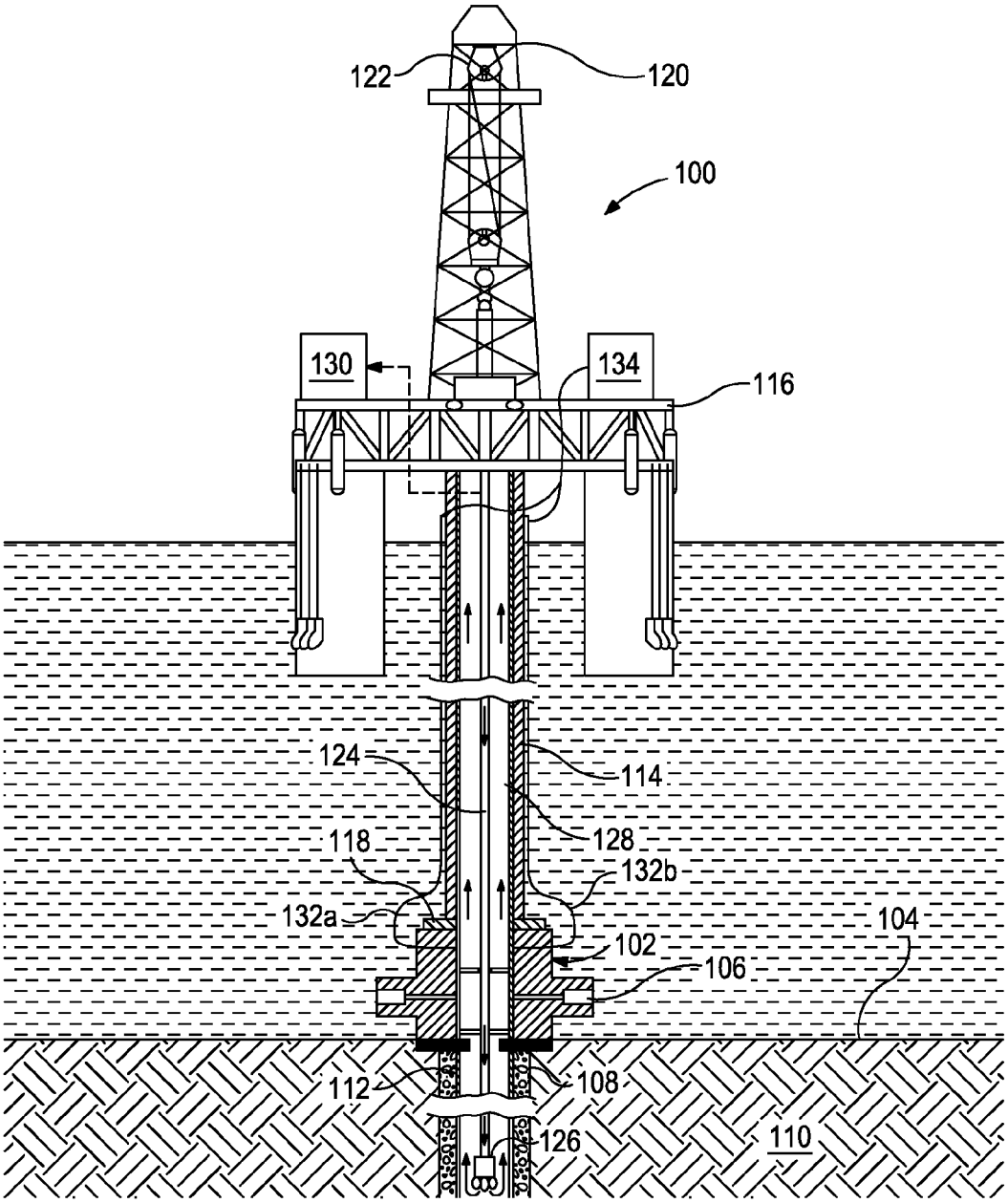
FIG. 1 illustrates an offshore drilling facility.

Referring to FIG. 1, illustrated is an exemplary offshore drilling facility 100 that may employ the systems and methods generally described herein. As illustrated, the drilling facility 100 is a semi-submersible offshore oil and gas platform, but may equally be replaced with any type of offshore drilling unit including, but not limited to submersible platforms or rigs, jack-up rigs, offshore support vessels, offshore production platforms, or the like. The drilling facility 100 may be generally centered over a subsea wellhead installation 102 located on the sea floor 104. The wellhead installation 102 may include one or more blowout preventers 106 and, in some embodiments, the wellhead installation 102 itself may be generally characterized or otherwise referred to herein as a blowout preventer.

As depicted, a wellbore 108 extends below the wellhead installation 102 and has been drilled through various earth strata 110 in order to provide access to one or more subterranean hydrocarbon formations (not shown). A casing string 112 has been cemented within the wellbore 108 and generally seals the wellbore 108 along its longitudinal length.

A subsea conduit or marine riser 114 extends from the rig floor or deck 116 of the drilling facility 100 to the wellhead installation 102 at the sea floor 104. In some embodiments, a flex joint 118 may be installed on or otherwise form part of the wellhead installation 102 and provide a flexible coupling for sealingly connecting the marine riser 114 to the wellhead installation 102. As the sea currents change, or as the drilling facility 100 undergoes rig heaving, the marine riser 114 shifts in response thereto and the flex joint 118 provides an amount of flexure that maintains a sealed connection between the riser 114 and the wellhead installation 102.

The drilling facility 100 has a derrick 120 and a hoisting apparatus 122 for raising and lowering pipe strings, such as a work string 124, into and out of the riser 114 and the wellbore 108. Those skilled in the art will readily recognize that various tools, sensors, and other equipment may be coupled to the work string 124 in order to undertake required drilling operations designed to extend the wellbore 108 and thereby access subterranean hydrocarbon formations (not shown). For example, a drill bit 126 may be attached to the end of the work string 124 and used to cut or otherwise drill through the earth strata 110. In some drilling operations, a drilling fluid or mud is pumped down the work string 124 to the drill bit 126 to keep the drill bit 126 cool and clean during drilling operations, and may also be used to transmit hydraulic energy to various downhole tools and measuring devices. The drilling fluid also serves to circulate cuttings and debris back to the surface through the annulus 128 defined between the work string 124 and the wellbore 108 and/or riser 114. The circulated cuttings and debris are eventually deposited in a mud pit 130 located at the drilling facility 100 where the drilling fluid is reconditioned for recycling and reuse.

The drilling facility 100 may further include one or more hydraulic lines 132*a* and 132*b* that extend from the rig floor 116 to the wellhead installation 102. At the rig floor 116, the hydraulic lines 132*a,b* may be coupled to one or more high-pressure rig pumps 134 (one shown) configured to provide hydraulic pressure to the hydraulic lines 132*a,b*. In some embodiments, the hydraulic lines 132*a,b* may be booster lines or choke/kill lines used to regulate the fluid pressure within the wellhead installation 102 and the annulus 128. As discussed in greater detail below, however, the hydraulic lines 132*a,b* may also be used to provide the hydraulic pressure necessary to displace the drilling fluid from the riser 114 when it is desired to disconnect the riser 114 from the wellhead installation 102.

Figure 2:
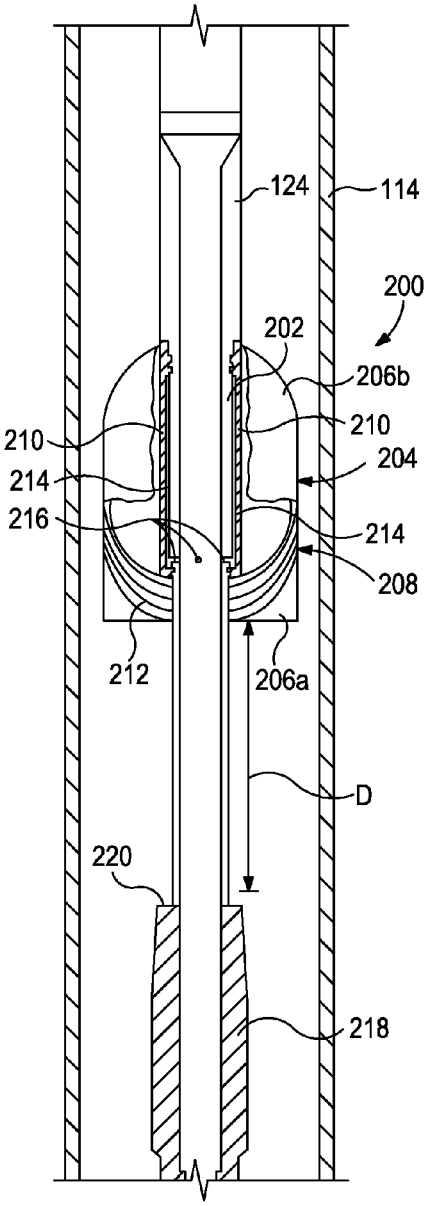
FIG. 2 illustrates an exemplary riser displacement system in its un-deployed configuration, according to one or more embodiments disclosed.

Referring now to FIG. 2, with continued reference to FIG. 1, illustrated is an exemplary riser displacement system 200, according to one or more embodiments disclosed. The riser displacement system 200 is illustrated in FIG. 2 in its "run-in" or un-deployed configuration. The system 200 may be coupled to or otherwise form part of the work string 124, and therefore may be introduced into the interior of the riser 114 and advanced therethrough similar to any other portion or length of the work string 124. In some embodiments, the system 200 may be stored on the drilling facility 100 (FIG. 1) in a condition that would allow for quick attachment to the work string 124 and subsequent introduction into the riser 114. In at least one embodiment, for example, the system 200 may be coupled to a joint of drill pipe (not shown) so that after its use it can be racked back into the derrick 120 (FIG. 1) with minimal effort. To prevent or minimize damage while being racked into the derrick 120 or introduced into the riser 114, the system 200 may be designed or otherwise manufactured using high strength or robust materials.

The riser displacement system 200 may include a mandrel 202 coupled or otherwise attached to an elongate tubular which, in some embodiments, may be a length of the work string 124. In some embodiments, the mandrel 202 may be threaded to the work string 124. In other embodiments, however, the mandrel 202 may be mechanically fastened to the work string 124 using, for example, one or more mechanical fasteners, adhesives, magnets, welding or brazing techniques, combinations thereof, or the like. In yet other embodiments, the mandrel 202 may form an integral part of a portion of the work string 124 and may therefore otherwise be defined thereon.

Figure 3:
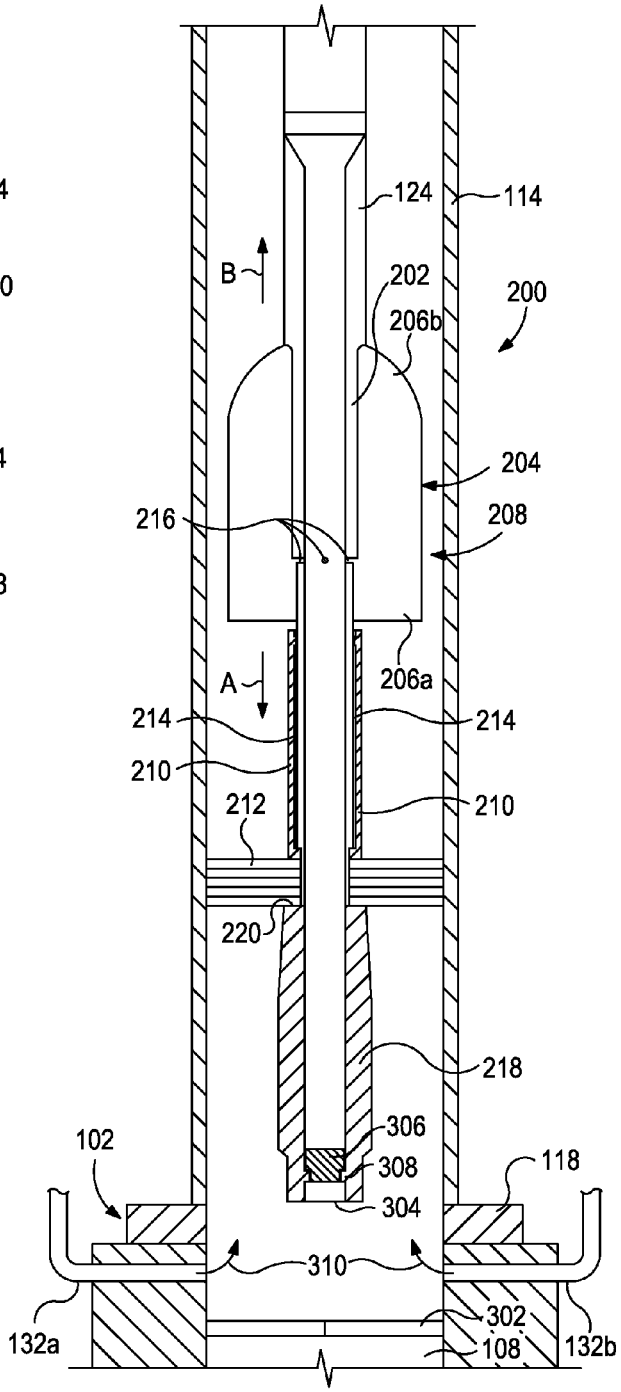
FIG. 3 illustrates the riser displacement system of FIG. 2 in its deployed configuration, according to one or more embodiments disclosed.

The system 200 may also include a seal containment canister 204, depicted in FIG. 2 in a partial cross-sectional view, and a seal assembly 208 that may be generally housed within the seal containment canister 204 as the system 200 is run into the riser 114. The seal containment canister 204 may be arranged about at least a portion of the mandrel 202 and otherwise coupled to the work string 124. As illustrated, the seal containment canister 204 may be generally open at its distal end 206*a*, but closed off or otherwise sealed on its proximal end 206*b*. As shown in FIG. 2, the seal assembly 208 is in its un-deployed or retracted configuration. As discussed in greater detail below, however, the seal assembly 208 may be able to axially translate out of the seal containment canister 204 and thereby move into a deployed configuration, as generally illustrated in FIG. 3.

The seal assembly 208 may include a sleeve 210 and one or more sealing elements 212 coupled or otherwise attached to the sleeve 210. In the illustrated embodiment, the sealing elements 212 are coupled to a distal end of the sleeve 210, however other configurations may also be used. In one embodiment, the seal assembly 208 may be a monolithic element, where the sleeve 210 and the one or more sealing elements 212 are integrally formed with each other. In other embodiments, however, the sleeve 210 and the one or more sealing elements 212 may be separate and distinct components of the seal assembly 208, without departing from the scope of the disclosure. The one or more sealing elements 212 may be made of suitable, flexible materials including, but not limited to, elastomers, flexible metals, fabrics, carbon fiber, composites, plastics, combinations thereof, and the like.

The sleeve 210 may be arranged about and otherwise movably attached to the outer radial surface of the mandrel 202, and a piston bore 214 may be defined therebetween. The piston bore 214 may be in fluid communication with the interior of the work string 124 via one or more orifices 216 (three shown) defined in the work string 124 and/or the mandrel 202. The orifices 216 may provide fluid conduits whereby the piston bore 214 may be pressurized, thereby creating a pressure differential across the piston bore 214 which effectively forces the sleeve 210 to translate axially with respect to the mandrel 202 (e.g., downhole or downward in FIG. 2).

The one or more sealing elements 212 may be arranged about the outer radial surface of the mandrel 202 and extend radially therefrom. In some embodiments, the sealing elements 212 may be movably coupled to the mandrel 202. Specifically, as the sleeve 210 is forced axially downhole, the one or more sealing elements 212 may be configured to translate along the outer radial surface of the mandrel 202, thereby moving the seal assembly 208 out of the seal containment canister 204 and into its deployed configuration (as seen in FIG. 3). In other embodiments, however, the containment canister 204 may be configured to translate in the upward direction with respect to the mandrel 202 as the piston bore 214 is pressurized. As the containment canister 204 moves axially upward, the seal assembly 208 is equally moved out of the seal containment canister 204 and into the deployed configuration. As will be appreciated, such a configuration would be able to tag up on a closed blind ram 302 (FIG. 3) and deploy the sealing elements 212 without relative movement of the work string 124 (ignoring heave).

The system 200 may further include a lower adapter 218 that may be axially spaced from the seal assembly 208 as the system 200 is run into the riser 114. The lower adapter 218 may be coupled or otherwise attached to the work string 124. In some embodiments, the lower adapter 218 may be threaded to the work string 124. In other embodiments, however, the lower adapter 218 may be mechanically fastened to the work string 124 using, for example, one or more mechanical fasteners, adhesives, magnets, welding or brazing techniques, combinations thereof, or the like. In yet other embodiments, the lower adapter 218 may form an integral part of the work string 124 and may therefore otherwise be defined thereon. The lower adapter 218 may define an upper shoulder 220 configured to engage and stop the axial descent of the one or more seal elements 212. Accordingly, the lower adapter 218 may be characterized or otherwise referred to herein, in at least one embodiment, as a downstop.

As illustrated, the lower adapter 218 may be axially spaced from the seal assembly 208 as the system 200 is run into the riser 114 by a distance D. The distance D may provide the seal assembly 208 with a travel distance or spacing used to account for rig heave or other axial fluctuations in the riser 114 after the seal assembly 208 has been deployed for operation. For example, oceanic waves or undersea currents may cause the work string 124 to fluctuate vertically inside the riser 114 while the one or more sealing elements 212 remain in constant relative contact with the inner radial surface of the riser 114. Accordingly, while retrieving the system 200 from the riser 114, the one or more sealing elements 212 may be free to move up and down the distance D along the axial length of the system 200. Those skilled in the art will readily appreciate that the distance D may be any distance suitable for the particular application where the system 200 may be used. For example, the distance D may be about 2 feet, about 5 feet, about 10 feet, about 20 feet, about 50 feet, about 100 feet, or more than about 100 feet, without departing from the scope of the disclosure.

Referring now to FIG. 3, with continued reference to FIG. 2, illustrated is the riser displacement system 200 in its deployed configuration, according to one or more embodiments disclosed. When it is desired to disconnect the riser 114 from the wellhead installation 102, the riser displacement system 200 may be introduced into the riser 114 which will typically be filled with drilling fluid. In some embodiments, one or more blind rams 302 will be closed on the wellhead installation 102 in order to seal the contents of the wellbore 108 below and above the wellhead installation 102.

The riser displacement system 200 may be run into the riser 114 until engaging the top of the wellhead installation 102 or otherwise coming into close proximity thereto. In some embodiments, seawater or another displacement fluid may be pumped through the interior of the work string 124 and out the bottom 304 thereof in order to displace the portion of the drilling fluid near the bottom of the riser displacement system 200. For instance, a pump down device 306, such as a plug or a dart, may be released from surface and displaced with seawater to put seawater inside the work string 124, thereby allowing the operator to pull a clean work string 124 (i.e., no mud or drilling fluid inside). Moreover, having seawater inside the work string 124 will eliminate the threat of dumping drilling mud from the work string 124 as it is being retrieved from the riser 114.

With the riser displacement system 200 at or otherwise substantially adjacent the top of the wellhead installation 102, the work string 124 may be hydraulically pressurized. The pump down device 306 may be configured to "blank off" or seal the bottom 304 of the work string 124. In at least one embodiment, the pump down device 306 may be conveyed through the work string 124 until becoming engaged on a radial shoulder 308 or other profile defined on the inner radial surface of the work string 124. Engagement between the pump down device 306 and the radial shoulder 308 may generate a mechanical seal therebetween, thereby allowing fluid to be injected into the work string 124 in order to increase its internal pressure.

As the pressure within the work string 124 increases, and as briefly mentioned above, the orifices 216 defined in the mandrel 202 may communicate fluid pressure from the work string 124 into the piston bore 214, thereby generating a pressure differential and forcing the sleeve 210 to translate axially in the direction A. In other embodiments, however, as also described briefly above, the containment canister 204 may be configured to translate with respect to the mandrel 202 in the opposing direction B, without departing from the scope of the disclosure.

Axially translating the sleeve 210 in the direction A with respect to the mandrel 202 and work string 124 also serves to axially translate the one or more sealing elements 212 in the direction A. As the sealing elements 212 are moved in the downward A, they are eventually deployed out the distal end 206*a* of the seal containment canister 204. In some embodiments, the one or more sealing elements 212 may be characterized as pig or swab cups configured to sealingly engage the inner radial surface of the riser 114 when properly deployed from the seal containment canister 204. Consequently, the sealing elements 212 may generate a seal against the inner radial surface of the riser 114 whereby the fluids present within the riser 114 above the deployed sealing elements 212 may be generally separated or isolated from the fluids present within the riser 114 below the deployed sealing elements 212.

In its deployed configuration, the riser displacement system 200 may be ready to be advanced back toward the surface in the direction B and, as a result, effectively displace the volume of the riser 114 above the sealing elements 212. Specifically, as the deployed riser displacement system 200 is advanced back toward the surface in the direction B, the drilling fluid present within the riser 114 above the deployed sealing elements 212 will be simultaneously forced out of the riser 114. In some embodiments, the one or more sealing elements 212 may also be characterized as wipers or scrapers configured to mechanically clean or scrape the inner radial surface of the riser 114 as the system 200 is returned toward the surface in the direction B.

In at least one embodiment, to advance the riser displacement system 200 back to the surface in the direction B, a displacement fluid 310 may be pumped through one or more of the hydraulic lines 132*a,b* and injected into the riser 114 below the deployed sealing elements 212. In one or more embodiments, the displacement fluid 310 is seawater. In other embodiments, however, any "green" fluid could be used, without departing from the scope of the disclosure. Seawater, however, is free, readily available, and environmentally compatible with the surrounding oceanic environment, and therefore may be the most practical fluid to use.

As the displacement fluid 310 is injected into the riser 114 below the one or more sealing elements 212, the work string 124 may be pulled back toward the surface (i.e., the rig floor of FIG. 1) at a rate that matches or is generally close to the injection flowrate of the displacement fluid 310. In other embodiments, the displacement fluid 310 may be pumped into the riser 114 such that the fluid pressure exerted by the drilling fluid above the sealing elements 212 is surpassed by the fluid pressure exerted by the incoming displacement fluid 310 below the sealing elements 212. As a result, the displacement fluid 310 may be used to essentially pump the riser displacement system 200 out of the riser 114 from below, and simultaneously displace the volume (e.g., drilling fluid) of the riser 114. In yet other embodiments, the riser displacement system 200 is simultaneously pulled and pumped back toward the surface, without departing from the scope of the disclosure. In operation, it may be beneficial to ensure that the pull rate does not exceed the displacement fluid velocity inside the riser 114, otherwise the sealing elements 212 may not be able to lift within the riser 114 without experiencing significant bypassing until the displacement system 200 nears the surface and the differential pressure across the sealing elements 212 drops to near zero.

Referring again to FIG. 1, with continued reference to FIGS. 2 and 3, once the riser displacement system 200 reaches the top of the riser 114 and the rig floor 116, the riser 114 will be completely filled with the displacement fluid 310 and the drilling fluid will be appropriately removed from the riser 114 and conveyed to the mud pits 134 for reconditioning and/or storage. In embodiments where the displacement fluid 310 is seawater, the riser 114 may then be safely disconnected from the wellhead installation 102 and the displacement fluid 310 discharged directly into the surrounding oceanic environment with little or no environmental impact. Moreover, as a result of the sealing engagement between the one or more sealing elements 212 and the inner radial surface of the riser 114, the drilling fluid displaced from the riser 114 will experience minimal contamination with the displacement fluid 310, or any other external contaminant. As a result, reconditioning costs for the drilling fluid will be minimized. Furthermore, since the riser displacement system 200 is incorporated directly into the work string 124, it may simply be removed from the work string 124, re-racked on the derrick 120, and stored until needed at a subsequent time.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A riser displacement system, comprising:

a mandrel coupled to a work string;

a seal containment canister arranged about at least a portion of the mandrel;

a seal assembly movable between an un-deployed configuration, where the seal assembly is arranged within the seal containment canister, and a deployed configuration, where the seal assembly is arranged outside of the seal containment canister, the seal assembly including a sleeve movably arranged about the mandrel and one or more sealing elements disposed at a distal end of the sleeve; and a piston bore defined between the sleeve and the mandrel, the piston bore being in fluid communication with an interior of the work string via one or more orifices defined in the mandrel.

2. The riser displacement system of claim 1, wherein the one or more sealing elements are movably arranged about an outer radial surface of the mandrel.

3. The riser displacement system of claim 2, wherein, when in the deployed configuration, the one or more sealing elements sealingly engage an inner radial surface of the riser.

4. The riser displacement system of claim 1, further comprising a lower adapter axially spaced from the seal containment canister and coupled to the work string.

5. A method of displacing a volume of a riser, comprising:

coupling a riser displacement system to a work string, the riser displacement system including a mandrel and a seal containment canister arranged about at least a portion of the mandrel, the seal containment canister having a seal assembly arranged therein that includes a sleeve movably arranged about the mandrel and one or more sealing elements;

introducing the riser displacement system into the riser from a surface, the riser being at least partially filled with a drilling fluid;

pressurizing the work string and thereby pressurizing a piston bore defined between the sleeve and the mandrel, the piston bore being in fluid communication with an interior of the work string via one or more orifices defined in the mandrel;

hydraulically forcing the sleeve out a distal end of the seal containment canister and thereby deploying the seal assembly from the seal containment canister, whereby the one or more sealing elements sealingly engage an inner radial surface of the riser;

advancing the riser displacement system back towards the surface; and displacing the drilling fluid above the one or more sealing elements from the riser as the riser displacement system is advanced back towards the surface.

6. The method of claim 5, wherein pressurizing the work string to deploy the seal assembly from the seal containment canister further comprises:

introducing a pump down device into the work string;

sealing the work string with the pump down device;

increasing a fluid pressure within the work string;

communicating the fluid pressure into the piston bore via the one or more orifices and thereby generating a pressure differential across the sleeve; and forcing the sleeve and the one or more seal elements out the distal end of the seal containment canister and into a deployed configuration.

7. The method of claim 6, further comprising sealingly engaging the inner radial surface of the riser with the one or more sealing elements such that the drilling fluid present within the riser above the one or more sealing elements is separated from fluids present within the riser below the one or more sealing elements.

8. The method of claim 5, further comprising pumping a displacement fluid into the riser below the riser displacement system.

9. The method of claim 8, wherein advancing the riser displacement system back towards the surface further comprises pulling the riser displacement system towards the surface as attached to the work string extended from the surface.

10. The method of claim 8, wherein advancing the riser displacement system back towards the surface further comprises increasing the fluid pressure of the displacement fluid below the one or more sealing elements, thereby pumping the riser displacement system out of the riser from below.

11. The method of claim 8, wherein advancing the riser displacement system back towards the surface further comprises:

increasing the fluid pressure of the displacement fluid below the one or more sealing elements, thereby pumping the riser displacement system out of the riser from below; and pulling the riser displacement system towards the surface at a rate lower than a velocity of the displacement fluid within the riser, the riser displacement system being attached to the work string as extended from the surface.

12. The method of claim 5, wherein the riser displacement system further comprises a lower adapter axially spaced a distance from the seal containment canister and coupled to the work string, and wherein advancing the riser displacement system back towards the surface further comprises:

allowing the seal assembly to axially fluctuate over the distance as the riser displacement system ascends the riser.

13. A method of displacing drilling fluid from a riser extending from a rig floor of an offshore facility, comprising:

introducing a riser displacement system into the riser at the rig floor, the riser displacement system including a mandrel and a seal containment canister arranged about at least a portion of the mandrel, the seal containment canister having a seal assembly arranged therein that includes a sleeve and one or more sealing elements movably arranged about the mandrel;

advancing the riser displacement system to a wellhead installation;

deploying the seal assembly from the seal containment canister;

sealing an inner radial surface of the riser with the one or more sealing elements thereby separating the drilling fluid present within the riser above the one or more sealing elements from fluids present within the riser below the one or more sealing elements;

advancing the riser displacement system back towards the rig floor; and displacing the drilling fluid from the riser as the riser displacement system is advanced back towards the rig floor.

14. The method of claim 13, further comprising pumping a displacement fluid into the riser below the riser displacement system with one or more hydraulic lines.

15. The method of claim 14, wherein advancing the riser displacement system back towards the rig floor further comprises pulling the riser displacement system towards the rig floor at a rate lower than a velocity of the displacement fluid within the riser, the riser displacement system being attached to the work string as extended from the rig floor.

16. The method of claim 14, wherein advancing the riser displacement system back towards the rig floor further comprises increasing the fluid pressure of the displacement fluid below the one or more sealing elements, thereby pumping the riser displacement system out of the riser from below.

17. The method of claim 14, wherein advancing the riser displacement system back towards the rig floor further comprises:

increasing the fluid pressure of the displacement fluid below the one or more sealing elements, thereby pumping the riser displacement system out of the riser from below; and pulling the riser displacement system towards the rig floor at a rate lower than a velocity of the displacement fluid within the riser, the riser displacement system being attached to the work string as extended from the rig floor.

18. The method of claim 13, wherein the riser displacement system further comprises a lower adapter axially spaced a distance from the seal containment canister, and wherein advancing the riser displacement system back towards the surface further comprises:

allowing the seal assembly to axially fluctuate over the distance as the riser displacement system ascends the riser.

19. The method of claim 13, wherein deploying the seal assembly from the seal containment canister further comprises:

increasing a fluid pressure within the riser displacement system;

communicating the fluid pressure into a piston bore defined between the sleeve and the mandrel via one or more orifices defined in the mandrel, thereby generating a pressure differential across the sleeve; and forcing the sleeve and the one or more seal elements out a distal end of the seal containment canister and into a deployed configuration.

20. The method of claim 13, wherein deploying the seal assembly from the seal containment canister further comprises advancing the seal assembly in a downward direction out of the seal containment canister.

21. The method of claim 13, wherein deploying the seal assembly from the seal containment canister further comprises advancing the seal containment canister in an upward direction with respect to the seal assembly.

* * * * *